US007550415B2

(12) United States Patent
Fujitsu et al.

(10) Patent No.: US 7,550,415 B2
(45) Date of Patent: Jun. 23, 2009

(54) LUBRICATING OIL COMPOSITION

(75) Inventors: Takashi Fujitsu, Kanagawa (JP); Joanna Griffiths, Chester (GB)

(73) Assignee: Shell Oil Company, Houston, TX (US)

( * ) Notice: Subject to any disclaimer, the term of this patent is extended or adjusted under 35 U.S.C. 154(b) by 637 days.

(21) Appl. No.: 11/298,872

(22) Filed: Dec. 9, 2005

(65) Prior Publication Data

US 2006/0189489 A1 Aug. 24, 2006

(30) Foreign Application Priority Data

Dec. 10, 2004 (EP) ..... 04257691

(51) Int. Cl.
*C10M 135/22* (2006.01)

(52) U.S. Cl. ..... 508/447

(58) Field of Classification Search ..... 508/477
See application file for complete search history.

(56) References Cited

U.S. PATENT DOCUMENTS

| | | | | |
|---|---|---|---|---|
| 2,053,045 | A | 9/1936 | Ralston et al. | 87/9 |
| 2,125,851 | A | 8/1938 | Ralston | 87/9 |
| 2,788,326 | A | 4/1957 | Bondi et al. | 252/56 |
| 3,223,631 | A | 12/1965 | Morway et al. | 252/33.6 |
| 3,933,659 | A | 1/1976 | Lyle et al. | 252/32.7 |
| 4,025,446 | A | 5/1977 | Cier et al. | 252/51.5 R |
| 4,376,056 | A | 3/1983 | Erdman | 252/56 R |
| 4,683,069 | A | 7/1987 | Brewster et al. | 252/32.7 |
| 5,114,603 | A | 5/1992 | Kennedy et al. | 252/56 R |
| 5,145,594 | A | 9/1992 | Anton et al. | 252/68 |
| 5,286,394 | A | 2/1994 | Moore | 252/36 |
| 5,858,931 | A * | 1/1999 | Tanaka et al. | 508/364 |
| 6,486,101 | B2 * | 11/2002 | Luciani et al. | 508/232 |
| 6,562,765 | B1 | 5/2003 | Boffa | 508/221 |
| 2003/0181339 | A1 * | 9/2003 | Watts et al. | 508/195 |

FOREIGN PATENT DOCUMENTS

| | | | |
|---|---|---|---|
| EP | 0335701 | A2 | 10/1989 |
| EP | 0668342 | A1 | 8/1995 |
| EP | 0747464 | A1 | 12/1996 |
| EP | 0776959 | A2 | 6/1997 |
| EP | 0799883 | A1 | 10/1997 |
| EP | 1041135 | A1 | 10/2000 |
| EP | 1367116 | A1 | 12/2003 |
| JP | 5350291 | | 10/1976 |
| JP | 5356610 | | 10/1976 |
| JP | 56120679 | | 10/1979 |
| JP | 58171488 | | 2/1982 |
| WO | WO9202602 | | 2/1992 |
| WO | WO9721788 | | 6/1997 |
| WO | WO9826030 | | 6/1998 |
| WO | WO9920720 | | 4/1999 |
| WO | WO9931113 | | 6/1999 |
| WO | WO9941332 | | 8/1999 |
| WO | WO9947629 | | 9/1999 |
| WO | WO9950377 | | 10/1999 |
| WO | WO9966013 | | 12/1999 |
| WO | WO0008115 | | 2/2000 |
| WO | WO0014179 | | 3/2000 |
| WO | WO0118156 | A1 | 3/2001 |
| WO | WO0157166 | A1 | 8/2001 |

* cited by examiner

*Primary Examiner*—Walter D Griffin
*Assistant Examiner*—Frank C Campanell

(57) ABSTRACT

A lubricating oil composition is disclosed containing base oil, glycerol monooleate and one or more nitrile compounds. A method of lubricating an internal combustion engine is also disclosed.

21 Claims, 1 Drawing Sheet

LUBRICATING OIL COMPOSITION

FIELD OF THE INVENTION

The present invention relates to a lubricating oil composition, in particular to a lubricating oil composition which is useful for lubricating internal combustion engines.

BACKGROUND OF THE INVENTION

Increasingly severe automobile regulations in respect of emissions and fuel efficiency are placing increasing demands on both engine manufacturers and lubricant formulators to provide effective solutions to improve fuel economy.

Friction-reducing additives (which are also known as friction modifiers) are important lubricant components in reducing fuel consumption and various such additives are already known in the art.

Friction modifiers can be conveniently divided into two categories, that is to say, metal-containing friction modifiers and ashless (organic) friction modifiers.

Organo-molybdenum compounds are amongst the most common metal-containing friction modifiers. Typical organo-molybdenum compounds include molybdenum dithiocarbamates (MoDTC), molybdenum dithiophosphates (MoDTP), molybdenum amines, molybdenum alcoholates, and molybdenum alcoholamides. WO-A-98/26030, WO-A-99/31113, WO-A-99/47629 and WO-A-99/66013 describe tri-nuclear molybdenum compounds for use in lubricating oil compositions.

However, the trend towards low-ash lubricating oil compositions has resulted in an increased drive to achieve low friction and improved fuel economy using ashless (organic) friction modifiers.

Ashless (organic) friction modifiers typically comprise esters of fatty acids and polyhydric alcohols, fatty acid amides, amines derived from fatty acids and organic dithiocarbamate or dithiophosphate compounds.

Further improvements in lubricant performance characteristics have been achieved through the use of synergistic behaviours of particular combinations of certain lubricant additives.

WO-A-99/50377 describes a lubricating oil composition which is said to have a significant increase in fuel economy due to the use therein of tri-nuclear molybdenum compounds in conjunction with oil soluble dithiocarbamates.

EP-A-1041135 describes the use of succinimide dispersants in conjunction with molybdenum dialkyldithiocarbamates which is said to give improved friction reduction in diesel engines.

U.S. Pat. No.-B1-6,562,765 describes a lubricating oil composition which is said to have a synergy between an oxymolybdenum nitrogen dispersant complex and an oxymolybdenum dithiocarbamate which leads to unexpectedly low friction coefficients.

EP-A-1367116, EP-A-0799883, EP-A-0747464 U.S. Pat. No. 3,933,659 and EP-A-335701 describe lubricating oil compositions comprising various combinations of ashless friction modifiers.

WO-A-92/02602 describes lubricating oil compositions for internal combustion engines which comprise a blend of ashless friction modifiers which are said to have a synergistic effect on fuel economy.

The blend described in WO-A-92/02602 is a combination of (a) an amine/amide friction modifier prepared by reacting one or more acids with one or more polyamines and (b) an ester/alcohol friction modifier prepared by reacting one or more acids with one or more polyols.

U.S. Pat. No. 5,286,394 describes a friction-reducing lubricating oil composition and a method for reducing the fuel consumption of an internal combustion engine.

The lubricating oil composition described therein comprises a major amount of an oil having lubricating viscosity and a minor amount of a friction-modifying, polar and surface active organic compound selected from a long list of compounds including mono- and higher esters of polyols and aliphatic amides. Glycerol monooleate and oleamide (i.e. oleylamide) are mentioned as examples of such compounds.

However, current strategies with regard to friction reduction for fuel economy oils are not sufficient to meet ever increasing fuel economy targets set by Original Equipment Manufacturers (OEMs).

For example, molybdenum friction modifiers typically outperform ashless friction modifiers in the boundary regime and there is a need and a challenge to approach similar levels of friction modification using solely ashless friction modifiers.

SUMMARY OF THE INVENTION

A lubricating oil composition is provided containing base oil, glycerol monooleate and at least one nitrile compound. A method of lubricating an internal combustion engine using such lubricating oil is also provided.

BRIEF DESCRIPTION OF THE DRAWINGS

The FIGURE is a graph comparing friction of coefficient data.

BRIEF DESCRIPTION OF THE INVENTION

Figure 1:
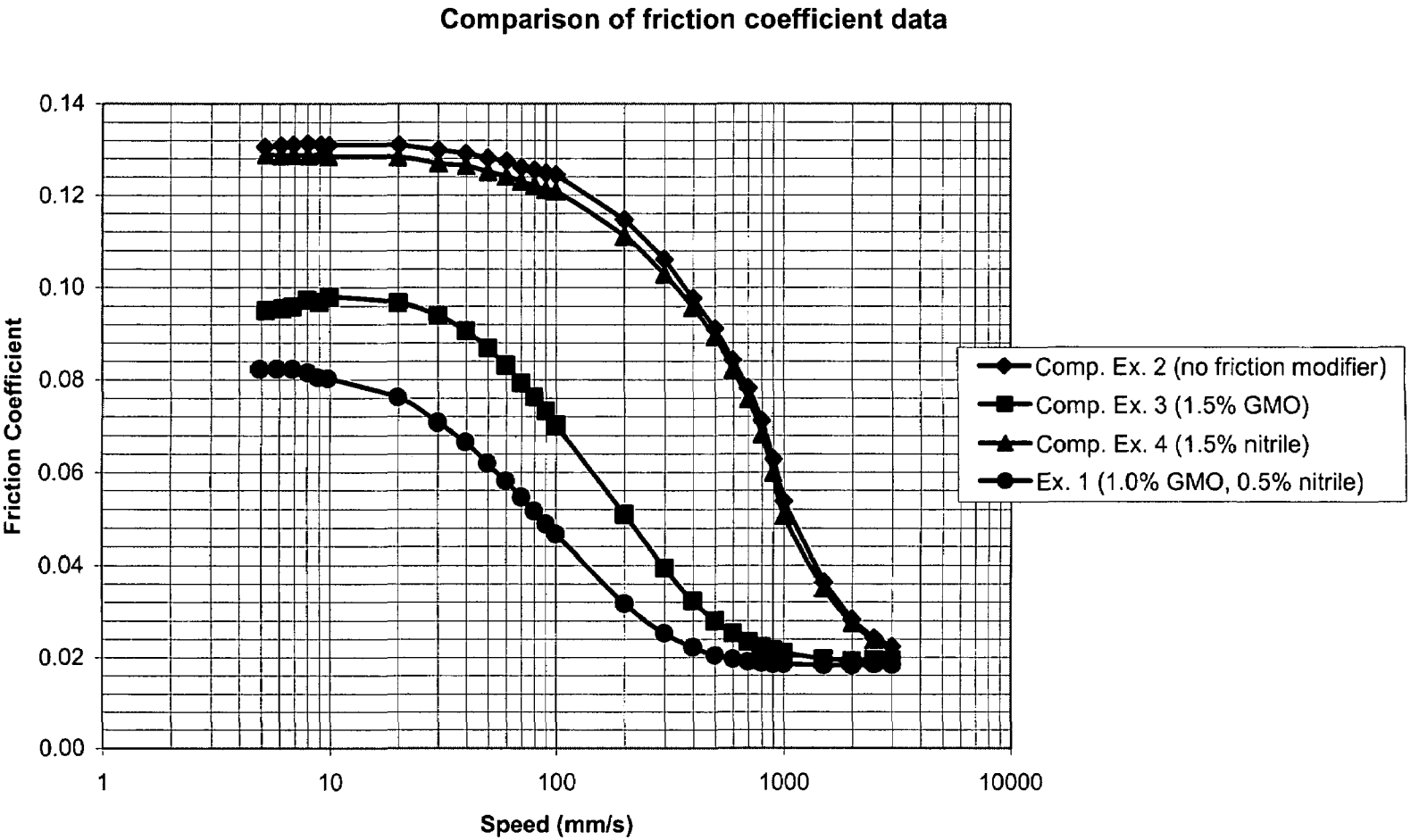

Given the increasing fuel economy demands placed on engines, there remains a need to further improve the friction reduction and fuel economy of internal combustion engines utilising low ash lubricating oil compositions.

It is therefore desirable to further improve on the performance of known ashless friction modifiers and known combinations of ashless friction modifiers, in particular to further improve on the friction-reducing performance of polyol ester friction modifiers such as glycerol monooleate.

There has now been found in the present invention a lubricating oil composition comprising a combination of ashless friction modifiers which has good friction reduction and fuel economy.

Accordingly, the present invention provides a lubricating oil composition comprising base oil, glycerol monooleate and one or more nitrile compounds.

It will be appreciated that glycerol monooleate has two possible structures, that is to say structures (I) and (II) indicated below.

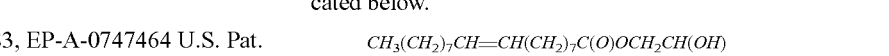

$$CH_3(CH_2)_7CH{=}CH(CH_2)_7C(O)OCH_2CH(OH)CH_2OH \quad (I)$$

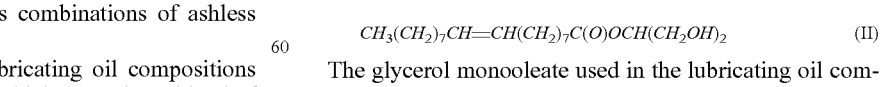

$$CH_3(CH_2)_7CH{=}CH(CH_2)_7C(O)OCH(CH_2OH)_2 \quad (II)$$

The glycerol monooleate used in the lubricating oil composition of the present invention may be conveniently present as compound having structure (I), compound having structure (II) or mixtures thereof.

In a preferred embodiment of the present invention, glycerol monooleate is present in an amount in the range of from 0.05 to 5.0 wt. %, more preferably in the range of from 0.5 to 3.0 wt. % and most preferably in the range of from 0.7 to 1.5 wt. %, based on the total weight of the lubricating oil composition.

Preferred nitrile compounds that may be conveniently employed in the present invention are saturated and unsaturated hydrocarbon compounds containing one or more cyano (—C═N) groups, which compounds preferably do not comprise any additional functional group substituents.

Particularly preferred nitrile compounds that may be conveniently employed in the present invention are branched or linear, saturated or unsaturated aliphatic nitrites.

Nitrile compounds preferably having from 8 to 24 carbon atoms, more preferably from 10 to 22 carbon atoms, and most preferably from 10 to 18 carbon atoms are preferred.

Particularly preferred nitrile compounds are saturated or unsaturated linear aliphatic nitrites having from 8 to 24 carbon atoms, more preferably from 10 to 22 carbon atoms, and most preferably 10 to 18 carbon atoms.

Examples of nitrile compounds that may be conveniently used in the present invention include coconut fatty acid nitrites, oleylnitrile, decanenitrile, and tallow nitrites and mixtures thereof.

Preferred nitrile compounds that may be conveniently used in the present invention include that a vailable under the trade designation "ARNEEL 12" (also known under the trade designation "ARNEEL C") (coconut fatty acid nitrile, a mixture of C10, C12, C14 and C16 saturated nitrites) from Akzo Nobel, that available under the trade designation "ARNEEL O" (oleylnitrile) from Akzo Nobel and those available under the trade designations "ARNEEL 10D" (decanenitrile), "ARNEEL T" (tallow nitrites) and "ARNEEL M" ($C_{16-22}$ nitrites) from Akzo Nobel.

In a preferred embodiment of the present invention, the one or more nitrile compounds are present in an amount in the range of from 0.1 to 1.0 wt. %, more preferably in the range of from 0.2 to 0.8 wt. % and most preferably in the range of from 0.3 to 0.6 wt. %, based on the total weight of the lubricating oil composition.

In a preferred embodiment, the lubricating oil composition of the present invention may contain at least one additional polyhydric alcohol ester each present in an additive amount in the range of from 0.1 to 1.0 wt. %, based on the total weight of the lubricating oil composition.

The additional polyhydric alcohol ester is preferably each present in an additive amount in the range of from 0.3 to 0.6 wt. %, based on the total weight of the lubricating oil composition.

It will be appreciated that if the additional polyhydric alcohol esters are each present in the lubricating oil composition of the present invention in an amount greater than 1.0% wt., then said esters are considered to be a base oil component rather than an additive component.

Preferred additional polyhydric alcohol esters include other glycerol esters such as glycerol dioleate, glycerol trioleate, neopentyl glycol esters such as neopentyl glycol oleate, pentaerythritol esters such as pentaerythritol oleate and trimethylolpropane (TMP) esters such as trimethylolpropane oleate and trimethylolpropane stearate.

The total amount of base oil incorporated in the lubricating oil composition of the present invention is preferably present in an amount in the range of from 60 to 92 wt. %, more preferably in an amount in the range of from 75 to 90 wt. % and most preferably in an amount in the range of from 75 to 88 wt. %, with respect to the total weight of the lubricating oil composition.

There are no particular limitations regarding the base oil used in the present invention, and various conventional known mineral oils and synthetic oils may be conveniently used.

The base oil used in the present invention may conveniently comprise mixtures of one or more mineral oils and/or one or more synthetic oils.

Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Naphthenic base oils have low viscosity index (VI) (generally 40-80) and a low pour point. Such base oils are produced from feedstocks rich in naphthenes and low in wax content and are used mainly for lubricants in which colour and colour stability are important, and VI and oxidation stability are of secondary importance.

Paraffinic base oils have higher VI (generally >95) and a high pour point. Said base oils are produced from feedstocks rich in paraffins, and are used for lubricants in which VI and oxidation stability are important.

Fischer-Tropsch derived base oils may be conveniently used as the base oil in the lubricating oil composition of the present invention, for example, the Fischer-Tropsch derived base oils disclosed in EP-A-776959, EP-A-668342, WO-A-97/21788, WO-00/15736, WO-00/14188, WO-00/14187, WO-00/14183, WO-00/14179, WO-00/08115, WO-99/41332, EP-1029029, WO-01/18156 and WO-01/57166.

Synthetic processes enable molecules to be built from simpler substances or to have their structures modified to give the precise properties required.

Synthetic oils include hydrocarbon oils such as olefin oligomers (PAOs), dibasic acids esters, polyol esters, and dewaxed waxy raffinate. Synthetic hydrocarbon base oils sold by the Royal Dutch/Shell Group of Companies under the designation "XHVI" (trade mark) may be conveniently used.

Preferably, the base oil is constituted from mineral oils and/or synthetic oils which contain more than 80% wt of saturates, preferably more than 90% wt., as measured according to ASTM D2007.

It is further preferred that the base oil contains less than 1.0 wt. %, preferably less than 0.1 wt. % of sulphur, calculated as elemental sulphur and measured according to ASTM D2622, ASTM D4294, ASTM D4927 or ASTM D3120.

Preferably, the viscosity index of base fluid is more than 80, more preferably more than 120, as measured according to ASTM D2270.

Preferably, the lubricating oil has a kinematic viscosity in the range of from 2 to 80 $mm^2/s$ at 100° C., more preferably in the range of from 3 to 70 $mm^2/s$, most preferably in the range of from 4 to 50 $mm^2/s$.

The total amount of phosphorus in the lubricating oil composition of the present invention is preferably in the range of from 0.04 to 0.1 wt. %, more preferably in the range of from 0.04 to 0.09 wt. % and most preferably in the range of from 0.045 to 0.09 wt. %, based on total weight of the lubricating oil composition.

The lubricating oil composition of the present invention preferably has a sulphated ash content of not greater than 1.0 wt. %, more preferably not greater than 0.75 wt. % and most preferably not greater than 0.7 wt. %, based on the total weight of the lubricating oil composition.

The lubricating oil composition of the present invention preferably has a sulphur content of not greater than 1.2 wt. %, more preferably not greater than 0.8 wt. % and most preferably not greater than 0.2 wt. %, based on the total weight of the lubricating oil composition.

The lubricating oil composition of the present invention may further comprise additional additives such as anti-oxidants, anti-wear additives, detergents, dispersants, friction modifiers, viscosity index improvers, pour point depressants, corrosion inhibitors, defoaming agents and seal fix or seal compatibility agents.

Antioxidants that may be conveniently used include those selected from the group of aminic antioxidants and/or phenolic antioxidants.

In a preferred embodiment, the antioxidants are present in an amount in the range of from 0.1 to 5.0 wt. %, more preferably in an amount in the range of from 0.3 to 3.0 wt. %, and most preferably in an amount of in the range of from 0.5 to 1.5 wt. %, based on the total weight of the lubricating oil composition.

Examples of aminic antioxidants which may be conveniently used include alkylated diphenylamines, phenyl-α-naphthylamines, phenyl-β-naphthylamines and alkylated α-naphthylamines.

Preferred aminic antioxidants include dialkyldiphenylamines such as p,p'-dioctyl-diphenylamine, p,p'-di-α-methylbenzyl-diphenylamine and N-p-butylphenyl-N-p'-octylphenylamine, monoalkyldiphenylamines such as mono-t-butyldiphenylamine and mono-octyldiphenylamine, bis(dialkylphenyl)amines such as di-(2,4-diethylphenyl)amine and di(2-ethyl-4-nonylphenyl)amine, alkylphenyl-1-naphthylamines such as octylphenyl-1-naphthylamine and n-t-dodecylphenyl-1-naphthylamine, 1-naphthylamine, arylnaphthylamines such as phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine and 3,7-dioctylphenothiazine.

Preferred aminic antioxidants include those available under the following trade designations: "Sonoflex OD-3" (ex. Seiko Kagaku Co.), "Irganox L-57" (ex. Ciba Specialty Chemicals Co.) and phenothiazine (ex. Hodogaya Kagaku Co.).

Examples of phenolic antioxidants which may be conveniently used include C7-C9 branched alkyl esters of 3,5-bis(1,1-dimethyl-ethyl)-4-hydroxy-benzenepropanoic acid, 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone, 2,6-di-t-butyl-4-alkylphenols such as 2,6-di-t-butylphenol, 2,6-di-t-butyl-4-methylphenol and 2,6-di-t-butyl-4-ethylphenol, 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptooctylacetate, alkyl-3-(3,5-di-t-butyl-4-hydroxyphenyl)propionates such as n-octadecyl-3-(3,5-di-t-butyl-4-hydroxyphenyl)propionate, n-butyl-3-(3,5-di-t-butyl-4-hydroxyphenyl)propionate and 2'-ethylhexyl-3-(3,5-di-t-butyl-4-hydroxyphenyl)propionate, 2,6-d-t-butyl-a-dimethylamino-p-cresol, 2,2'-methylenebis(4-alkyl-6-t-butylphenol) such as 2,2'-methylenebis(4-methyl-6-t-butylphenol, and 2,2-methylenebis(4-ethyl-6-t-butylphenol), bisphenols such as 4,4'-butylidenebis(3-methyl-6-t-butylphenol, 4,4'-methylenebis(2,6-di-t-butylphenol), 4,4'-bis(2,6-di-t-butylphenol), 2,2-(di-p-hydroxyphenyl)propane, 2,2-bis(3,5-di-t-butyl-4-hydroxyphenyl)propane, 4,4'-cyclohexylidenebis(2,6-t-butylphenol), hexamethyleneglycol-bis[3-(3,5-di-t-butyl-4-hydroxyphenyl)propionate], triethyleneglycol-bis[3-(3-t-butyl-4-hydroxy-5-methylphenyl)propionate], 2,2'-thio-[diethyl-3-(3,5-di-t-butyl-4-hydroxyphenyl)propionate], 3,9-bis{1,1-dimethyl-2-[3-(3-t-butyl-4-hydroxy-5-methylphenyl)-propionyloxy]ethyl}2,4,8,10-tetraoxaspiro[5,5]undecane, 4,4'-thiobis(3-methyl-6-t-butylphenol) and 2,2'-thiobis(4,6-di-t-butylresorcinol), polyphenols such as tetrakis[methylene-3-(3,5-di-t-butyl-4-hydroxyphenyl)propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis-[3,3'-bis(4'-hydroxy-3'-t-butylphenyl)butyric acid]glycol ester, 2-(3',5'-di-t-butyl-4-hydroxyphenyl)methyl-4-(2Δ,4"-di-t-butyl-3"-hydroxyphenyl)methyl-6-t-butylphenol and 2,6-bis(2'-hydroxy-3'-t-butyl-5'-methylbenzyl)-4-methylphenol, and p-t-butylphenol—formaldehyde condensates and p-t-butylphenol—acetaldehyde condensates.

Preferred phenolic antioxidants include those available under the following trade designations: "Irganox L-135" (ex. Ciba Specialty Chemicals Co.), "Yoshinox SS" (ex. Yoshitomi Seiyaku Co.), "Antage W-400" (ex. Kawaguchi Kagaku Co.), "Antage W-500" (ex. Kawaguchi Kagaku Co.), "Antage W-300" (ex. Kawaguchi Kagaku Co.), "Irganox L109" (ex. Ciba Speciality Chemicals Co.), "Tominox 917" (ex. Yoshitomi Seiyaku Co.), "Irganox L115" (ex. Ciba Speciality Chemicals Co.), "Sumilizer GA80" (ex. Sumitomo Kagaku), "Antage RC" (ex. Kawaguchi Kagaku Co.), "Irganox L101" (ex. Ciba Speciality Chemicals Co.), "Yoshinox 930" (ex. Yoshitomi Seiyaku Co.).

The lubricating oil composition of the present invention may comprise mixtures of one or more phenolic antioxidants with one or more aminic antioxidants.

In a preferred embodiment, the lubricating oil composition may comprise a single zinc dithiophosphate or a combination of two or more zinc dithiophosphates as anti-wear additives, the or each zinc dithiophosphate being selected from zinc dialkyl-, diaryl- or alkylaryl-dithiophosphates.

Zinc dithiophosphate is a well known additive in the art and may be conveniently represented by general formula II;

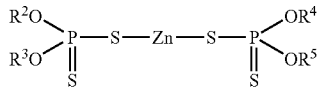

(II)

wherein $R^2$ to $R^5$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted with an alkyl group, said alkyl substituent containing from 1 to 20 carbon atoms preferably 3 to 18 carbon atoms.

Zinc dithiophosphate compounds in which $R^2$ to $R^5$ are all different from each other can be used alone or in admixture with zinc dithiophosphate compounds in which $R^2$ to $R^5$ are all the same.

Preferably, the or each zinc dithiophosphate used in the present invention is a zinc dialkyl dithiophosphate.

Examples of suitable zinc dithiophosphates which are commercially available include those available ex. Lubrizol Corporation under the trade designations "Lz 1097" and "Lz 1395", those available ex. Chevron Oronite under the trade designations "OLOA 267" and "OLOA 269R", and that available ex. Afton Chemical under the trade designation "HITEC 7197"; zinc dithiophosphates such as those available ex. Lubrizol Corporation under the trade designations "Lz 677A", "Lz 1095" and "Lz 1371", that available ex. Chevron Oronite under the trade designation "OLOA 262" and that available ex. Afton Chemical under the trade designation "HITEC 7169"; and zinc dithiophosphates such as those available ex. Lubrizol Corporation under the trade designations "Lz 1370" and "Lz 1373" and that available ex. Chevron Oronite under the trade designation "OLOA 260".

The lubricating oil composition according to the present invention may generally comprise in the range of from 0.4 to 1.0 wt. % of zinc dithiophosphate, based on total weight of the lubricating oil composition.

Additional or alternative anti-wear additives may be conveniently used in the lubricating oil composition of the present invention.

Typical detergents that may be used in the lubricating oil composition of the present invention include one or more salicylate and/or phenate and/or sulphonate detergents.

However, as metal organic and inorganic base salts which are used as detergents can contribute to the sulphated ash content of a lubricating oil composition, in a preferred embodiment of the present invention, the amounts of such additives are minimised.

Furthermore, in order to maintain a low sulphur level, salicylate detergents are preferred.

Thus, in a preferred embodiment, the lubricating oil composition of the present invention may comprise one or more salicylate detergents.

In order to maintain the total sulphated ash content of the lubricating oil composition of the present invention at a level of preferably not greater than 1.0 wt. %, more preferably at a level of not greater than 0.75 wt. % and most preferably at a level of not greater than 0.7 wt. %, based on the total weight of the lubricating oil composition, said detergents are preferably used in amounts in the range of 0.05 to 12.5 wt. %, more preferably from 1.0 to 9.0 wt. % and most preferably in the range of from 2.0 to 5.0 wt. %, based on the total weight of the lubricating oil composition.

Furthermore, it is preferred that said detergents, independently, have a TBN (total base number) value in the range of from 10 to 500 mg.KOH/g, more preferably in the range of from 30 to 350 mg.KOH/g and most preferably in the range of from 50 to 300 mg.KOH/g, as measured by ISO 3771.

The lubricating oil compositions of the present invention may additionally contain an ash-free dispersant which is preferably admixed in an amount in the range of from 5 to 15 wt. %, based on the total weight of the lubricating oil composition.

Examples of ash-free dispersants which may be used include the polyalkenyl succinimides and polyalkenyl succininic acid esters disclosed in Japanese Laid-Open Patent Application Nos. JP 53-050291, JP 56-120679, JP 53-056610 and JP 58-171488. Preferred dispersants include borated succinimides.

Examples of viscosity index improvers which may conveniently used in the lubricating oil composition of the present invention include the styrene-butadiene copolymers, styrene-isoprene stellate copolymers and the polymethacrylate copolymer and ethylene-propylene copolymers. Such viscosity index improvers may be conveniently employed in an amount in the range of from 1 to 20 wt. %, based on the total weight of the lubricating oil composition.

Polymethacrylates may be conveniently employed in the lubricating oil compositions of the present invention as effective pour point depressants.

Furthermore, compounds such as alkenyl succinic acid or ester moieties thereof, benzotriazole-based compounds and thiodiazole-based compounds may be conveniently used in the lubricating oil composition of the present invention as corrosion inhibitors.

Compounds such as polysiloxanes, dimethyl polycyclohexane and polyacrylates may be conveniently used in the lubricating oil composition of the present invention as defoaming agents.

Compounds which may be conveniently used in the lubricating oil composition of the present invention as seal fix or seal compatibility agents include, for example, commercially available aromatic esters.

The lubricating oil compositions of the present invention may be conveniently prepared by admixing glycerol monooleate, one or more nitrile compounds and, optionally, one or more additional polyhydric alcohol esters and/or further additives that are usually present in lubricating oil compositions, for example as herein before described, with a mineral and/or synthetic base oil.

In another embodiment of the present invention, there is provided a method of lubricating an internal combustion engine comprising applying a lubricating oil composition as hereinbefore described thereto.

The present invention further provides the use of a combination of glycerol monooleate, one or more nitrile compounds and, optionally, one or more additional polyhydric alcohol esters in a lubricating oil composition in order to improve fuel economy and/or friction reduction.

In one embodiment of the present invention, the lubricating oil composition may further comprise one or more thickening agents in order to form a grease composition.

Such grease compositions may be used in various kinds of bearings, gears and joints, such a ball joints and constant velocity joints.

Thickening agents that may be conveniently used include lithium soap, lithium complex soap and urea compounds. However, said thickening agents may also conveniently be clays, and fatty acid soaps of calcium, sodium, aluminium and barium.

The one or more thickening agents may be preferably present in an amount in the range of from 2 to 30% by weight, more preferably in the range of from 5 to 20% by weight, based on the total weight of the lubricating oil composition.

Lithium soap thickened greases have been known for many years. Typically, the lithium soap thickening agents are derived from $C_{10-24}$, preferably $C_{15-18}$, saturated or unsaturated fatty acids or derivatives thereof. One particular derivative is hydrogenated castor oil, which is the glyceride of 12-hydroxystearic acid.

12-hydroxystearic acid is a particularly preferred fatty acid.

Greases thickened with complex thickening agents are well known. In addition to a fatty acid salt, they incorporate into the thickener a complexing agent which is commonly a low to medium molecular weight acid or dibasic acid or one of its salts, such as benzoic acid or boric acid or a lithium borate.

Urea compounds used as thickening agents in greases include the urea group (—NHCONH—) in their molecular structure. These compounds include mono-, di- or polyurea compounds, depending upon the number of urea linkages.

The thickening agent preferably comprises a urea compound, a simple lithium soap or a complex lithium soap. A preferred urea compound is a polyurea compound.

In accordance with the present invention there is further provided a method of lubricating a constant velocity joint comprising packing it with lubricating grease comprising the lubricating oil composition of the present invention and one or more thickening agents.

In accordance with the present invention there is still further provided a constant velocity joint packed with said lubricating grease.

Preferably, the constant velocity joint is, generally, a plunging constant velocity joint but may, for instance, include high speed universal joints, which may include fixed or plunging types of constant velocity joints, or Hooke's type universal joint.

The present invention is described below with reference to the following Examples, which are not intended to limit the scope of the present invention in any way.

EXAMPLES

Formulations

Tables 1 and 2 indicate the formulations that were tested.

The formulations in Tables 1 and 2 comprised conventional detergents, dispersants, pour point depressants, antioxidants, viscosity modifier and zinc dithiophosphate additives, which were present as additive packages in diluent oil.

The base oils used in said formulations were mixtures of polyalphaolefin base oils (PAO-4 available from BP Amoco under the trade designation "DURASYN 164" and PAO-5 available from Chevron Oronite under the trade designation "SYNFLUID 5") and ester base oil available under the trade designation "PRIOLUBE 1976" from Uniqema.

The glycerol monooleate that was used was that available under the trade designation "RADIASURF 7149" from Oleon Chemicals.

A commercially available mixture of coconut fatty acid nitriles (predominantly C12 nitrile) was used-that was available under the trade designation "ARNEEL 12" from Akzo Nobel.

The oleylnitrile used was that available under the trade designation "ARNEEL O" from Akzo Nobel.

The decanenitrile used was that available under the trade designation "ARNEEL 10D" from A kzo Nobel.

The tallow nitrites used were those available under the trade designation "ARNEEL T" from A kzo Nobel.

A commercially available mixture of C16-22 nitrites was used that was available under the trade designation "ARNEEL M" from Akzo Nobel.

The ester additive used was trimethylol propane monooleate available under the trade designation "ADEKA FM-110" from Asahi Denka Kogyo Co. Ltd.

All formulations described in Tables 1 and 2 were SAE OW20 viscosity grade oils.

The formulations were manufactured by blending together the components therein in a single stage blending procedure at a temperature of 70° C. Heating was maintained for a minimum of 30 minutes to ensure thorough mixing, whilst the solution was mixed using a paddle stirrer.

TABLE 1

| Additive (wt. %) | Ex. 1 | Ex. 2 | Ex. 3 | Ex. 4 | Ex. 5 |
|---|---|---|---|---|---|
| Anti-foam | 30 ppm | 30 ppm | 30 ppm | 30 ppm | 30 ppm |
| Additive package* | 13.60 | 13.60 | 13.60 | 13.60 | 13.60 |
| Glycerol monooleate | 1.00 | 1.00 | 1.00 | 1.00 | 1.00 |
| "ARNEEL 10D" nitrile | — | 0.50 | — | — | — |
| "ARNEEL O" nitrile | 0.50 | — | 0.50 | — | — |
| "ARNEEL T" nitrile | — | — | — | 0.50 | — |
| "ARNEEL M" nitrile | — | — | — | — | 0.50 |
| Ester | — | 0.50 | 0.50 | 0.50 | 0.50 |
| PAO-4 Base Oil | 17.40 | 17.40 | 17.40 | 17.40 | 17.40 |
| PAO-5 Base Oil | 57.50 | 57.00 | 57.00 | 57.00 | 57.00 |
| Ester Base Oil | 10.00 | 10.00 | 10.00 | 10.00 | 10.00 |
| TOTAL | 100 | 100 | 100 | 100 | 100 |

*Conventional additive package containing calcium salicylate detergents having TBNs of 165 mg · KOH/g and 280 mg · KOH/g, dispersant, pour point depressant, aminic and phenolic antioxidants, viscosity modifier, zinc dithiophosphate additives and diluent oil.

TABLE 2

| Additive (wt. %) | Comp. Ex. 1 | Comp. Ex. 2 | Comp. Ex. 3 | Comp. Ex. 4 | Comp. Ex. 5 |
|---|---|---|---|---|---|
| Anti-foam | 30 ppm | 30 ppm | 30 ppm | 30 ppm | 30 ppm |
| Additive package* | 13.60 | 13.60 | 13.60 | 13.60 | 13.60 |
| Glycerol monooleate | 1.00 | — | 1.50 | — | 1.00 |
| "ARNEEL 10D" nitrile | — | — | — | — | — |
| "ARNEEL O" nitrile | — | — | — | 1.50 | — |
| "ARNEEL T" nitrile | — | — | — | — | — |
| "ARNEEL M" nitrile | — | — | — | — | — |
| Ester | — | — | — | — | 0.50 |
| PAO-4 Base Oil | 17.40 | 17.40 | 17.40 | 17.40 | 17.40 |
| PAO-5 Base Oil | 58.00 | 59.00 | 57.50 | 57.50 | 57.50 |
| Ester Base Oil | 10.00 | 10.00 | 10.00 | 10.00 | 10.00 |
| TOTAL | 100 | 100 | 100 | 100 | 100 |

*Conventional additive package containing calcium salicylate detergents having TBNs of 165 mg · KOH/g and 280 mg · KOH/g, dispersant, pour point depressant, aminic and phenolic antioxidants, viscosity modifier, zinc dithiophosphate additives and diluent oil.

Mini-Traction Machine (MTM) Test

Friction measurements were carried out on a Mini-Traction Machine manufactured by PCS instruments.

The MTM Test was described by R. I. Taylor, E. Nagatomi, N. R. Horswill, D. M. James in "A screener test for the fuel economy potential of engine lubricants", presented at the 13th International Colloquium on Tribology, January 2002.

Friction coefficients were measured with the Mini-Traction Machine using the 'ball-on-disc' configuration.

The ball specimen was a polished steel ball bearing, 19.05 mm in diameter. The disc specimen was a polished bearing steel disc, 46 mm in diameter and 6 mm thick.

The ball specimen was secured concentrically on a motor driven shaft. The disc specimen was secured concentrically on another motor driven shaft. The ball was loaded against the disc to create a point contact area with minimum spin and skew components. At the point of contact, a slide to roll ratio of 100% was maintained by adjusting the surface speed of the ball and disc.

The tests were run at a pressure of 1.25 GPa (load of 71N) or 0.82 GPa (load of 20N) with variable temperatures and mean surface speeds as detailed in the results tables.

Results and Discussion

The formulations described in Tables 1 and 2 were tested using the afore-mentioned test and the results obtained thereon are detailed below:

Testing Under Low Load Conditions

The formulations of Examples 1 to 5 and Comparative Examples 1 to 5 were tested in the MTM test under low load (0.82 GPa) conditions at a variety of temperature conditions (45, 70, 105 and 125° C.) under a variety of speeds (2000, 1000, 500, 100, 50 and 10 mm/s).

Friction coefficients were measured and are described in the Tables below.

a) Formulation Comprising Combination of Glycerol Monooleate and Nitrile

The formulation of Example 1 which comprises glycerol monooleate and nitrile was tested and compared with the formulations of Comparative Examples 1 to 4 under low load conditions.

TABLE 3

| MTM Test Conditions | | Comp. | Comp. | Comp. | Comp. | |
|---|---|---|---|---|---|---|
| Temp. (° C.) | Speed (mm/s) | Ex. 1 | Ex. 2 | Ex. 3 | Ex. 4 | Ex. 1 |
| | | Friction Coefficient | | | | |
| 125 | 2000 | 0.0203 | 0.0486 | 0.0162 | 0.0450 | 0.0148 |
| 125 | 1000 | 0.0314 | 0.0808 | 0.0194 | 0.0792 | 0.0155 |
| 125 | 500 | 0.0590 | 0.1066 | 0.0305 | 0.1023 | 0.0196 |
| 125 | 100 | 0.1014 | 0.1282 | 0.0729 | 0.1252 | 0.0517 |
| 125 | 50 | 0.1067 | 0.1298 | 0.0868 | 0.1277 | 0.0660 |
| 125 | 10 | 0.1020 | 0.1316 | 0.0899 | 0.1301 | 0.0777 |
| 105 | 2000 | 0.0207 | 0.0283 | 0.0193 | 0.0276 | 0.0182 |
| 105 | 1000 | 0.0266 | 0.0538 | 0.0211 | 0.0507 | 0.0185 |
| 105 | 500 | 0.0428 | 0.0911 | 0.0280 | 0.0893 | 0.0205 |
| 105 | 100 | 0.0932 | 0.1245 | 0.0701 | 0.1209 | 0.0467 |
| 105 | 50 | 0.1047 | 0.1282 | 0.0868 | 0.1252 | 0.0620 |
| 105 | 10 | 0.1070 | 0.1310 | 0.0980 | 0.1284 | 0.0803 |
| 70 | 2000 | 0.0258 | 0.0266 | 0.0253 | 0.0265 | 0.0247 |
| 70 | 1000 | 0.0279 | 0.0333 | 0.0267 | 0.0327 | 0.0252 |
| 70 | 500 | 0.0329 | 0.0515 | 0.0285 | 0.0492 | 0.0258 |
| 70 | 100 | 0.0738 | 0.1093 | 0.0544 | 0.1047 | 0.0375 |
| 70 | 50 | 0.0933 | 0.1207 | 0.0723 | 0.1177 | 0.0506 |
| 70 | 10 | 0.1093 | 0.1303 | 0.0994 | 0.1270 | 0.0812 |
| 45 | 2000 | 0.0298 | nm | 0.0298 | 0.0297 | 0.0294 |
| 45 | 1000 | 0.0326 | Nm | 0.0323 | 0.0337 | 0.0314 |
| 45 | 500 | 0.0354 | Nm | 0.0341 | 0.0400 | 0.0328 |
| 45 | 100 | 0.0576 | Nm | 0.0452 | 0.0794 | 0.0366 |
| 45 | 50 | 0.0766 | Nm | 0.0594 | 0.1015 | 0.0432 |
| 45 | 10 | 0.1063 | Nm | 0.0929 | 0.1236 | 0.0738 |

nm = not measured.

FIG. 1 represents graphically the results of Table 3 at 105° C. for Example 1 and Comparative Examples 2 to 4.

It is apparent from Table 1 that at a total treat rate of 1.5%, the combination of glycerol monooleate and nitrile of Example 1 surprisingly gives rise to a synergistic reduction in friction coefficient vis-à-vis similar treat rates of only glycerol monooleate or only nitrile (as demonstrated by Comparative Examples 3 and 4).

Table 4 details the mean % friction reduction for the formulations of Example 1 and Comparative Examples 2-4, relative to the mean friction coefficients measured for the formulation of Comparative Example 1 by temperature with respect to speeds of 2000, 1000, 500, 100, 50 and 10 mm/s under the tested low load conditions.

Positive values in Table 4 indicate improved friction reduction (i.e. lower friction coefficients) relative to the mean friction coefficients measured for the formulation of Comparative Example 1 and negative values in Table 4 indicate worse friction reduction (i.e. increased friction coefficients) relative to the mean friction coefficients measured for the formulation of Comparative Example 1 at various temperatures.

TABLE 4

| MTM Test Conditions Temp. (° C.) | Comp. Ex. 1 Mean Friction Coefficient | Comp. Ex. 2 | Comp. Ex. 3 | Comp. Ex. 4 | Ex. 1 |
|---|---|---|---|---|---|
| | | Mean Friction Reduction (%)** | | | |
| 125 | 0.0701 | −75.8 | +27.6 | −69.7 | +42.6 |
| 105 | 0.0658 | −55.0 | +18.7 | −50.3 | +35.0 |
| 70 | 0.0605 | −29.3 | +12.9 | −25.6 | +26.0 |
| 45 | 0.0564 | nm | +10.2 | −17.1 | +20.5 |

**Relative mean friction coefficients measured for the formulation of Comparative Example 1.
nm = not measured.

Table 5 details the mean % friction reduction for the formulations of Example 1 and Comparative Examples 2 to 4, relative to the mean friction coefficients measured for the formulation of Comparative Example 1 by speed with respect to temperatures of 45, 70, 105 and 125° C. for Example 1 and Comparative Examples 3 to 4 and temperatures of 70, 105 and 125° C. for Comparative Example 2, under the tested low load conditions.

Positive values in Table 5 indicate improved friction reduction (i.e. lower friction coefficients) relative to the mean friction coefficients measured for the formulation of Comparative Example 1 and negative values in Table 5 indicate worse friction reduction (i.e. increased friction coefficients) relative to the mean friction coefficients measured for the formulation of Comparative Example 1.

TABLE 5

| MTM Test Conditions Speed (mm/s) | Comp. Ex. 1 Mean Friction Coefficient | Comp. Ex. 2 | Comp. Ex. 3 | Comp. Ex. 4 | Ex. 1 |
|---|---|---|---|---|---|
| | | Mean Friction Reduction (%)** | | | |
| 2000 | 0.0242 | −59.7 | +7.2 | −39.3 | +11.2 |
| 1000 | 0.0296 | −93.0 | +16.0 | −65.9 | +23.6 |
| 500 | 0.0425 | −83.4 | +25.0 | −61.1 | +37.0 |
| 100 | 0.0815 | −36.0 | +25.2 | −33.2 | +46.1 |
| 50 | 0.0953 | −24.5 | +20.2 | −24.5 | +42.1 |
| 10 | 0.1062 | −23.6 | +10.5 | −20.0 | +26.3 |

**Relative mean friction coefficients measured for the formulation of Comparative Example 1.

It is apparent from Tables 3 to 5 that the glycerol monooleate/nitrile combination of Example 1 shows synergistic friction reduction under low load conditions.

b) Formulations Comprising Combination of Glycerol Monooleate, Nitrile and Ester The formulations of Example 2 to 5 which comprise glycerol monooleate, nitrile and additional additive amounts of polyhydric alcohol ester were tested and compared with the formulation of Comparative Example 5 under low load conditions.

TABLE 6

| MTM Test Conditions | | Comp. | | | | |
|---|---|---|---|---|---|---|
| Temp. (° C.) | Speed (mm/s) | Ex. 5 | Ex. 2 | Ex. 3 | Ex. 4 | Ex. 5 |
| | | Friction Coefficient | | | | |
| 125 | 2000 | 0.0203 | 0.0159 | 0.0151 | 0.0195 | 0.0167 |
| 125 | 1000 | 0.0321 | 0.0191 | 0.0166 | 0.0274 | 0.0239 |
| 125 | 500 | 0.0588 | 0.0309 | 0.0224 | 0.0438 | 0.0476 |
| 125 | 100 | 0.1010 | 0.0727 | 0.0589 | 0.0852 | 0.0943 |
| 125 | 50 | 0.1069 | 0.0857 | 0.0747 | 0.0951 | 0.0997 |

TABLE 6-continued

| MTM Test Conditions Temp. (° C.) | Speed (mm/s) | Comp. Ex. 5 | Ex. 2 | Ex. 3 | Ex. 4 | Ex. 5 |
|---|---|---|---|---|---|---|
| | | Friction Coefficient | | | | |
| 125 | 10 | 0.1034 | 0.0886 | 0.0834 | 0.0915 | 0.0944 |
| 105 | 2000 | 0.0221 | 0.0189 | 0.0186 | 0.0213 | 0.0195 |
| 105 | 1000 | 0.0300 | 0.0208 | 0.0194 | 0.0265 | 0.0225 |
| 105 | 500 | 0.0466 | 0.0282 | 0.0226 | 0.0393 | 0.0356 |
| 105 | 100 | 0.0928 | 0.0689 | 0.0538 | 0.0826 | 0.0887 |
| 105 | 50 | 0.1044 | 0.0858 | 0.0714 | 0.0962 | 0.1003 |
| 105 | 10 | 0.1064 | 0.0978 | 0.0894 | 0.0988 | 0.1012 |
| 70 | 2000 | 0.0274 | 0.0250 | 0.0252 | 0.0260 | 0.0254 |
| 70 | 1000 | 0.0308 | 0.0265 | 0.0261 | 0.0285 | 0.0267 |
| 70 | 500 | 0.0385 | 0.0282 | 0.0269 | 0.0339 | 0.0296 |
| 70 | 100 | 0.0774 | 0.0547 | 0.0412 | 0.0687 | 0.0665 |
| 70 | 50 | 0.0925 | 0.0730 | 0.0561 | 0.0865 | 0.0877 |
| 70 | 10 | 0.1083 | 0.1010 | 0.0866 | 0.1047 | 0.1045 |
| 45 | 2000 | 0.0298 | 0.0298 | 0.0299 | 0.0300 | 0.0298 |
| 45 | 1000 | 0.0329 | 0.0323 | 0.0321 | 0.0329 | 0.0324 |
| 45 | 500 | 0.0373 | 0.0339 | 0.0334 | 0.0357 | 0.0342 |
| 45 | 100 | 0.0629 | 0.0458 | 0.0382 | 0.0563 | 0.0513 |
| 45 | 50 | 0.0768 | 0.0603 | 0.0462 | 0.0721 | 0.0705 |
| 45 | 10 | 0.1018 | 0.0940 | 0.0776 | 0.1014 | 0.1028 |

Table 7 details the mean % friction reduction for the formulations of Examples 2 to 5 and Comparative Example 5, relative to the mean friction coefficients measured for the formulation of Comparative Example 1 by temperature with respect to speeds of 2000, 1000, 500, 100, 50 and 10 mm/s under the tested low load conditions.

Positive values in Table 7 indicate improved friction reduction (i.e. lower friction coefficients) relative to the mean friction coefficients measured for the formulation of Comparative Example 1 and negative values in Table 7 indicate worse friction reduction (i.e. increased friction coefficients) relative to the mean friction coefficients measured for the formulation of Comparative Example 1 at various temperatures.

TABLE 7

| MTM Test Conditions Temp. (° C.) | Comp. Ex. 1 Mean Friction Coeff. | Comp. Ex. 5 | Ex. 2 | Ex. 3 | Ex. 4 | Ex. 5 |
|---|---|---|---|---|---|---|
| | | Mean Friction Reduction (%)** | | | | |
| 125 | 0.0701 | −0.5 | +28.3 | +37.5 | +13.3 | +13.7 |
| 105 | 0.0658 | −4.5 | +19.6 | +29.2 | +5.5 | +8.7 |
| 70 | 0.0605 | −6.1 | +12.9 | +22.0 | +2.1 | +6.0 |
| 45 | 0.0564 | −1.9 | +9.7 | +17.9 | +1.7 | +4.4 |

**Relative mean friction coefficients measured for the formulation of Comparative Example 1.

Table 8 details the mean % friction reduction for the formulations of Examples 2 to 5 and Comparative Example 5, relative to the mean friction coefficients measured for the formulation of Comparative Example 1 by speed with respect to temperatures of 45, 70, 105 and 125° C. under the tested low load conditions.

Positive values in Table 8 indicate improved friction reduction (i.e. lower friction coefficients) relative to the mean friction coefficients measured for the formulation of Comparative Example 1 and negative values in Table 8 indicate worse friction reduction (i.e. increased friction coefficients) relative to the mean friction coefficients measured for the formulation of Comparative Example 1.

TABLE 8

| MTM Test Conditions Speed (mm/s) | Comp. Ex. 1 Mean Friction Coeff. | Comp. Ex. 5 | Ex. 2 | Ex. 3 | Ex. 4 | Ex. 5 |
|---|---|---|---|---|---|---|
| | | Mean Friction Reduction (%)** | | | | |
| 2000 | 0.0242 | −3.2 | +8.4 | +9.4 | −0.1 | +6.3 |
| 1000 | 0.0296 | −6.6 | +16.7 | +20.5 | +2.5 | +11.1 |
| 500 | 0.0425 | −7.7 | +25.1 | +33.3 | +7.5 | +12.4 |
| 100 | 0.0815 | −3.3 | +25.2 | +40.5 | +9.1 | +8.2 |
| 50 | 0.0953 | +0.2 | +20.2 | +35.3 | +8.0 | +6.2 |
| 10 | 0.1062 | +1.1 | +10.2 | +20.6 | +6.7 | +5.1 |

**Relative mean friction coefficients measured for the formulation of Comparative Example 1.

It is apparent from Tables 6 to 8 that the glycerol monooleate/nitrile/ester combinations of Examples 2 to 5 show synergistic friction reduction with respect to the formulation of Comparative Example 5 under low load conditions.

Testing under High Load Conditions

The formulations of Examples 1 to 5 and Comparative Examples 1 to 5 were tested in the MTM test under high load (1.25 GPa) conditions at a variety of temperature conditions (45, 70, 105 and 125° C.) under a variety of speeds (2000, 1000, 500, 100, 50 and 10 mm/s).

Friction coefficients were measured and are described in the Tables below.

a) Formulation Comprising Combination of Glycerol Monooleate and Nitrile

The formulation of Example 1 which comprises glycerol monooleate and nitrile was tested and compared with the formulations of Comparative Examples 1 to 4 under high load conditions.

TABLE 9

| MTM Test Conditions Temp. (° C.) | Speed (mm/s) | Comp. Ex. 1 | Comp. Ex. 2 | Comp. Ex. 3 | Comp. Ex. 4 | Ex. 1 |
|---|---|---|---|---|---|---|
| | | Friction Coefficient | | | | |
| 125 | 2000 | 0.0280 | 0.0512 | 0.0248 | 0.0496 | 0.0235 |
| 125 | 1000 | 0.0403 | 0.0715 | 0.0294 | 0.0696 | 0.0260 |
| 125 | 500 | 0.0618 | 0.0895 | 0.0389 | 0.0866 | 0.0320 |
| 125 | 100 | 0.0919 | 0.1104 | 0.0688 | 0.1059 | 0.0582 |
| 125 | 50 | 0.0975 | 0.1121 | 0.0803 | 0.1074 | 0.0677 |
| 125 | 10 | 0.1000 | 0.1197 | 0.0909 | 0.1155 | 0.0777 |
| 105 | 2000 | 0.0292 | 0.0485 | 0.0269 | 0.0481 | 0.0257 |
| 105 | 1000 | 0.0388 | 0.0671 | 0.0311 | 0.0661 | 0.0283 |
| 105 | 500 | 0.0567 | 0.0835 | 0.0398 | 0.0805 | 0.0323 |
| 105 | 100 | 0.0888 | 0.1084 | 0.0700 | 0.1038 | 0.0557 |
| 105 | 50 | 0.0970 | 0.1121 | 0.0806 | 0.1080 | 0.0660 |
| 105 | 10 | 0.1061 | 0.1217 | 0.0954 | 0.1179 | 0.0820 |
| 70 | 2000 | 0.0318 | 0.0348 | 0.0314 | 0.0344 | 0.0309 |
| 70 | 1000 | 0.0368 | 0.0497 | 0.0352 | 0.0483 | 0.0341 |
| 70 | 500 | 0.0460 | 0.0694 | 0.0401 | 0.0674 | 0.0372 |
| 70 | 100 | 0.0817 | 0.0991 | 0.0642 | 0.0947 | 0.0527 |
| 70 | 50 | 0.0916 | 0.1056 | 0.0754 | 0.1016 | 0.0622 |
| 70 | 10 | 0.1064 | 0.1203 | 0.0949 | 0.1168 | 0.0828 |
| 45 | 2000 | 0.0345 | nm | 0.0345 | 0.0345 | 0.0344 |
| 45 | 1000 | 0.0395 | nm | 0.0391 | 0.0418 | 0.0389 |
| 45 | 500 | 0.0451 | nm | 0.0437 | 0.0536 | 0.0427 |
| 45 | 100 | 0.0721 | nm | 0.0601 | 0.0859 | 0.0534 |
| 45 | 50 | 0.0847 | nm | 0.0709 | 0.0941 | 0.0604 |
| 45 | 10 | 0.1038 | nm | 0.0912 | 0.1123 | 0.0793 |

nm = not measured.

Table 10 details the mean % friction reduction for the formulations of Example 1 and Comparative Examples 2-4, relative to the mean friction coefficients measured for the formulation of Comparative Example 1 by temperature with respect to speeds of 2000, 1000, 500, 100, 50 and 10 mm/s under the tested high load conditions.

Positive values in Table 10 indicate improved friction reduction (i.e. lower friction coefficients) relative to the mean friction coefficients measured for the formulation of Comparative Example 1 and negative values in Table 10 indicate worse friction reduction (i.e. increased friction coefficients) relative to the mean friction coefficients measured for the formulation of Comparative Example 1 at various temperatures.

TABLE 10

| MTM Test Conditions Temp. (° C.) | Comp. Ex. 1 Mean Friction Coefficient | Comp. Ex. 2 | Comp. Ex. 3 | Comp. Ex. 4 | Ex. 1 |
|---|---|---|---|---|---|
| | | Mean Friction Reduction (%)** | | | |
| 125 | 0.0699 | −43.3 | +21.2 | −38.5 | +31.6 |
| 105 | 0.0694 | −39.8 | +17.6 | −36.1 | +29.0 |
| 70 | 0.0657 | −24.2 | +11.4 | −20.4 | +19.8 |
| 45 | 0.0633 | nm | +8.2 | −10.5 | +14.2 |

**Relative mean friction coefficients measured for the formulation of Comparative Example 1.
nm = not measured.

Table 11 details the mean % friction reduction for the formulations of Example 1 and Comparative Examples 2 to 4, relative to the mean friction coefficients measured for the formulation of Comparative Example 1 by speed with respect to temperatures of 45, 70, 105 and 125° C. for Example 1 and Comparative Examples 3 to 4 and temperatures of 70, 105 and 125° C. for Comparative Example 2, under the tested high load conditions.

Positive values in Table 11 indicate improved friction reduction (i.e. lower friction coefficients) relative to the mean friction coefficients measured for the formulation of Comparative Example 1 and negative values in Table 11 indicate worse friction reduction (i.e. increased friction coefficients) relative to the mean friction coefficients measured for the formulation of Comparative Example 1.

TABLE 11

| MTM Test Conditions Speed (mm/s) | Comp. Ex. 1 Mean Friction Coefficient | Comp. Ex. 2 | Comp. Ex. 3 | Comp. Ex. 4 | Ex. 1 |
|---|---|---|---|---|---|
| | | Mean Friction Reduction (%)** | | | |
| 2000 | 0.0309 | −52.8 | +5.1 | −37.5 | +7.8 |
| 1000 | 0.0389 | −61.8 | +13.1 | −45.0 | +17.9 |
| 500 | 0.0524 | −47.7 | +20.7 | −36.9 | +28.9 |
| 100 | 0.0836 | −21.2 | +21.1 | −16.8 | +33.8 |
| 50 | 0.0927 | −15.3 | +17.1 | −10.9 | +30.8 |
| 10 | 0.1041 | −15.8 | +10.5 | −11.1 | +22.7 |

**Relative mean friction coefficients measured for the formulation of Comparative Example 1.

It is apparent from Tables 9 to 11 that the glycerol monooleate/nitrile combination of Example 1 shows synergistic friction reduction under high load conditions.

b) Formulations Comprising Combination of Glycerol Monooleate, Nitrile and Ester The formulations of Example 2 to 5 which comprise glycerol monooleate, nitrile and additional additive amounts of polyhydric alcohol ester were tested and compared with the formulation of Comparative Example 5 under high load conditions.

TABLE 12

| MTM Test Conditions Temp. (° C.) | Speed (mm/s) | Comp. Ex. 5 | Ex. 2 | Ex. 3 | Ex. 4 | Ex. 5 |
|---|---|---|---|---|---|---|
| | | Friction Coefficient | | | | |
| 125 | 2000 | 0.0268 | 0.0245 | 0.0237 | 0.0270 | 0.0262 |
| 125 | 1000 | 0.0378 | 0.0295 | 0.0266 | 0.0349 | 0.0357 |
| 125 | 500 | 0.0574 | 0.0392 | 0.0326 | 0.0482 | 0.0552 |
| 125 | 100 | 0.0889 | 0.0679 | 0.0584 | 0.0784 | 0.0873 |
| 125 | 50 | 0.0955 | 0.0796 | 0.0710 | 0.0873 | 0.0936 |
| 125 | 10 | 0.0994 | 0.0890 | 0.0844 | 0.0932 | 0.0960 |
| 105 | 2000 | 0.0301 | 0.0268 | 0.0263 | 0.0288 | 0.0278 |
| 105 | 1000 | 0.0399 | 0.0314 | 0.0293 | 0.0361 | 0.0356 |
| 105 | 500 | 0.0552 | 0.0406 | 0.0345 | 0.0486 | 0.0536 |
| 105 | 100 | 0.0862 | 0.0694 | 0.0586 | 0.0790 | 0.0861 |
| 105 | 50 | 0.0952 | 0.0805 | 0.0704 | 0.0885 | 0.0931 |
| 105 | 10 | 0.1072 | 0.0957 | 0.0872 | 0.0994 | 0.0998 |
| 70 | 2000 | 0.0321 | 0.0313 | 0.0312 | 0.0319 | 0.0315 |
| 70 | 1000 | 0.0377 | 0.0351 | 0.0346 | 0.0372 | 0.0358 |
| 70 | 500 | 0.0466 | 0.0402 | 0.0382 | 0.0448 | 0.0430 |
| 70 | 100 | 0.0794 | 0.0646 | 0.0553 | 0.0736 | 0.0769 |
| 70 | 50 | 0.0894 | 0.0755 | 0.0653 | 0.0845 | 0.0873 |
| 70 | 10 | 0.1059 | 0.0947 | 0.0857 | 0.1016 | 0.1027 |
| 45 | 2000 | 0.0353 | 0.0344 | 0.0345 | 0.0346 | 0.0346 |
| 45 | 1000 | 0.0417 | 0.0392 | 0.0392 | 0.0398 | 0.0393 |
| 45 | 500 | 0.0481 | 0.0436 | 0.0432 | 0.0456 | 0.0442 |
| 45 | 100 | 0.0734 | 0.0609 | 0.0549 | 0.0683 | 0.0679 |
| 45 | 50 | 0.0829 | 0.0710 | 0.0625 | 0.0791 | 0.0801 |
| 45 | 10 | 0.1015 | 0.0904 | 0.0808 | 0.0983 | 0.0986 |

Table 13 details the mean % friction reduction for the formulations of Examples 2 to 5 and Comparative Example 5, relative to the mean friction coefficients measured for the formulation of Comparative Example 1 by temperature with respect to speeds of 2000, 1000, 500, 100, 50 and 10 mm/s under the tested high load conditions.

Positive values in Table 13 indicate improved friction reduction (i.e. lower friction coefficients) relative to the mean friction coefficients measured for the formulation of Comparative Example 1 and negative values in Table 13 indicate worse friction reduction (i.e. increased friction coefficients) relative to the mean friction coefficients measured for the formulation of Comparative Example 1 at various temperatures.

TABLE 13

| MTM Test Conditions Temp. (° C.) | Comp. Ex. 1 Mean Friction Coeff. | Comp. Ex. 5 | Ex. 2 | Ex. 3 | Ex. 4 | Ex. 5 |
|---|---|---|---|---|---|---|
| | | Mean Friction Reduction (%)** | | | | |
| 125 | 0.0699 | +3.9 | +21.9 | +29.3 | +11.8 | +6.9 |
| 105 | 0.0694 | +0.1 | +17.4 | +25.5 | +8.1 | +5.3 |
| 70 | 0.0657 | +0.2 | +11.4 | +17.6 | +3.9 | +4.0 |
| 45 | 0.0633 | −2.0 | +8.2 | +12.9 | +2.5 | +3.1 |

**Relative mean friction coefficients measured for the formulation of Comparative Example 1.

Table 14 details the mean % friction reduction for the formulations of Examples 2 to 5 and Comparative Example 5, relative to the mean friction coefficients measured for the formulation of Comparative Example 1 by speed with respect to temperatures of 45, 70, 105 and 125° C. under the tested high load conditions.

Positive values in Table 14 indicate improved friction reduction (i.e. lower friction coefficients) relative to the mean friction coefficients measured for the formulation of Comparative Example 1 and negative values in Table 14 indicate worse friction reduction (i.e. increased friction coefficients)

relative to the mean friction coefficients meausred for the formulation of Comparative Example 1.

TABLE 14

| MTM Test Conditions Speed (mm/s) | Comp. Ex. 1 Mean Friction Coeff. | Comp. Ex. 5 | Ex. 2 | Ex. 3 | Ex. 4 | Ex. 5 |
|---|---|---|---|---|---|---|
| | | Mean Friction Reduction (%)** | | | | |
| 2000 | 0.0309 | −0.5 | +5.6 | +6.8 | +1.1 | +3.0 |
| 1000 | 0.0389 | −1.2 | +12.8 | +16.3 | +4.6 | +5.7 |
| 500 | 0.0524 | +0.5 | +20.2 | +26.9 | +9.4 | +6.2 |
| 100 | 0.0836 | +1.8 | +21.1 | +31.7 | +10.2 | +4.9 |
| 50 | 0.0927 | +2.1 | +17.3 | +27.4 | +8.4 | +4.5 |
| 10 | 0.1041 | +0.6 | +11.2 | +18.8 | +5.7 | +4.6 |

**Relative mean friction coefficients measured for the formulation of Comparative Example 1.

It is apparent from Tables 12 to 14 that the glycerol monooleate/nitrile/ester combinations of Examples 2 to 5 show synergistic friction reduction with respect to the formulation of Comparative Example 5.

The invention claimed is:

1. A lubricating oil composition comprising base oil, glycerol monooleate and at least one nitrile compound selected from the group consisting of coconut fatty acid nitriles, oleylnitrile, decanenitrile, tallow nitriles and mixtures thereof.

2. The lubricating oil composition of claim 1 wherein glycerol monooleate is present in an amount in the range of from 0.05 to 5.0 wt. %, based on the total weight of the lubricating oil composition.

3. The lubricating oil composition of claim 1 wherein said nitrile compound is present in an amount in the range of from 0.1 to 1.0 wt. %, based on the total weight of the lubricating oil composition.

4. The lubricating oil composition of claim 1 wherein the lubricating oil composition further comprise at lease one additional polyhydric alcohol ester each present in an additive amount in the range of from 0.1 to 1.0 wt. %, based on the total weight of the lubricating oil composition.

5. The lubricating oil composition of claim 4 wherein the additional polyhydric alcohol ester is selected from glycerol esters different than glycerol monooleate.

6. The lubricating oil of claim 5 wherein the additional polyhydric alcohol ester is selected from the group consisting of glycerol dioleate, glycerol trioleate, neopentyl glycol esters, pentaerythritol esters, trimethylolpropane esters, and mixtures thereof.

7. The lubricating oil composition of claim 4 wherein the additional polyhydric alcohol ester is each present in an additive amount in the range of from 0.3 to 0.6 wt. %, based on the total weight of the lubricating oil composition.

8. The lubricating oil composition of claim 1 wherein the lubricating oil composition has a total amount of phosphorus in the range of from 0.04 to 0.1 wt. and/or has a sulphur content of not greater than 1.2 wt. %, based on total weight of the lubricating oil composition.

9. The lubricating oil composition of claim 1 wherein the lubricating oil composition has a sulphated ash content of not greater than 1.0 wt. %, based on the total weight of the lubricating oil composition.

10. The lubricating oil composition of claim 1 wherein the lubricating oil composition further comprises at least one thickening agent.

11. A method of lubricating an internal combustion engine comprising applying a lubricating oil composition of claim 1 to the internal combustion engine.

12. A lubricating oil composition comprising base oil, glycerol monooleate and at least one nitrile compound having 8 to 24 carbon atoms.

13. A lubricating oil composition comprising: (a) base oil; (b) 0.05to 5.0 wt %, based on the total weight of the lubricating oil composition, of glycerol monooleate; (c) 0.1 to 1.0 wt %; based on the weight of the lubricating oil composition, of at least one nitrile compound having 8 to 24 carbon atoms; and (d) 0.1 to 1.0 wt %, based on the total weight of the lubricating oil composition of, at least one additional polyhydrin alcohol.

14. The lubricating oil composition of claim 13 wherein said lubricating oil composition has a total amount of phosphorus in the range of from 0.04 to 0.1 wt % and/or has a sulphur content of not greater than 1.2 wt %, based on total weight of the lubricating oil composition.

15. The lubricating oil composition of claim 12 wherein the lubricating oil composition further comprise at lease one additional polyhydric alcohol ester each present in an additive amount in the range of from 0.1 to 1.0 wt. %, based on the total weight of the lubricating oil composition.

16. The lubricating oil composition of claim 15 wherein the additional polyhydric alcohol ester is selected from the group consisting of glycerol dioleate, glycerol trioleate, neopentyl glycol esters, pentaerythritol esters, trimethylolpropane esters, and mixtures thereof.

17. The lubricating oil composition of claim 15 wherein the additional polyhydric alcohol ester is each present in an additive amount in the range of from 0.3to 0.6 wt. %, based on the total weight of the lubricating oil composition.

18. The lubricating oil composition of claim 12 wherein the lubricating oil composition has a total amount of phosphorus in the range of from 0.04 to 0.1 wt. and/or has a sulphur content of not greater than 1.2 wt. %, based on total weight of the lubricating oil composition.

19. The lubricating oil composition of claim 12 wherein the lubricating oil composition has a sulphated ash content of not greater than 1.0 wt. %, based on the total weight of the lubricating oil composition.

20. The lubricating oil composition of claim 12 wherein the lubricating oil composition further comprises at least one thickening agent.

21. A method of lubricating an internal combustion engine comprising applying a lubricating oil composition of claim 12 to the internal combustion engine.

* * * * *